US010533754B2

(12) United States Patent
Arteconi et al.

(10) Patent No.: US 10,533,754 B2
(45) Date of Patent: Jan. 14, 2020

(54) POT SUPPORT GRATE

(71) Applicant: INDESIT COMPANY S.P.A., Fabriano (IT)

(72) Inventors: Leonardo Arteconi, Fabriano (IT); Alberto Gasparini, Fabriano (IT)

(73) Assignee: Whirlpool Corporation, Benton Harbor, MI (US)

( * ) Notice: Subject to any disclaimer, the term of this patent is extended or adjusted under 35 U.S.C. 154(b) by 78 days.

(21) Appl. No.: 15/558,098

(22) PCT Filed: Feb. 4, 2016

(86) PCT No.: PCT/IB2016/050560
§ 371 (c)(1),
(2) Date: Sep. 13, 2017

(87) PCT Pub. No.: WO2016/147060
PCT Pub. Date: Sep. 22, 2016

(65) Prior Publication Data

US 2018/0051890 A1 Feb. 22, 2018

(30) Foreign Application Priority Data

Mar. 13, 2015 (IT) ..... TO2015A0165

(51) Int. Cl.
*F24C 15/10* (2006.01)
*F24C 15/36* (2006.01)
(Continued)

(52) U.S. Cl.
CPC ..... *F24C 15/107* (2013.01); *F24C 3/126* (2013.01); *F24C 7/083* (2013.01); *F24C 15/36* (2013.01)

(58) Field of Classification Search
CPC ..... F24C 15/107; F24C 15/36; F24C 3/126; F24C 7/083
(Continued)

(56) References Cited

U.S. PATENT DOCUMENTS 5,353,781 A * 10/1994 Calvillo ..... F24C 15/12 126/221
6,543,439 B1 * 4/2003 Kollner ..... F24C 15/14 126/221
(Continued)

FOREIGN PATENT DOCUMENTS

DE 102010042988 A1 5/2012
EP 0964207 A1 12/1999
(Continued)

OTHER PUBLICATIONS

"EP_2816292_A1_M—Machine Translation.pdf", machine translation, EPO.org, Mar. 30, 2019.*

*Primary Examiner* — Gregory L Huson
*Assistant Examiner* — Daniel E Namay
(74) *Attorney, Agent, or Firm* — Price Heneveld LLP

(57) ABSTRACT

A support grate for a household cooking appliance includes a plurality of spokes with at least one portion on which a cooking article can be supported and at least one pad of elastic material for supporting the grate on a surface of the household appliance. The pad is of a polymeric material having a thermochromic pigment dispersed therein and causing the pad to change in a color thereof at a first preset temperature.

10 Claims, 6 Drawing Sheets

(51) Int. Cl.
*F24C 7/08* (2006.01)
*F24C 3/12* (2006.01)

(58) Field of Classification Search
USPC ..... 126/211, 221, 219; 99/645, 341, 342
See application file for complete search history.

(56) References Cited

U.S. PATENT DOCUMENTS 8,878,108 B2 * 11/2014 Kitaizumi ..... H05B 6/1245 126/220
2004/0118394 A1 * 6/2004 Hawkins ..... F24C 15/107 126/215
2004/0239511 A1 * 12/2004 Urban ..... G01J 3/52 340/584
2007/0044788 A1 * 3/2007 Jacobs ..... F24C 15/108 126/211
2011/0088679 A1 4/2011 Lerner
2012/0132642 A1 * 5/2012 Broders ..... G05D 23/1902 219/488
2013/0319994 A1 * 12/2013 Bringe ..... F24C 15/104 219/391
2013/0340500 A1 * 12/2013 Miller ..... G01N 25/56 73/29.02
2015/0253014 A1 * 9/2015 Alonso Esteban ..... F24C 7/083 219/448.17
2015/0261018 A1 * 9/2015 Bretschneider ..... G02F 1/0147 257/89
2016/0037958 A1 * 2/2016 Freymiller ..... A47J 37/0611 426/233
2016/0349743 A1 * 12/2016 Burkhardt ..... H05B 1/0266

FOREIGN PATENT DOCUMENTS

EP 2816292 A1 12/2014
JP 06042751 A * 2/1994
JP 2011007491 A * 1/2011
JP 2014077593 A * 5/2014
JP 2015064126 A * 4/2015

* cited by examiner

POT SUPPORT GRATE

TECHNICAL FIELD

The present invention relates to pot support grates for household cooking appliances.

BACKGROUND

As is known, cooking tops and similar household cooking appliances are equipped, for supporting pots over burners, with grates that may have different shapes and/or dimensions depending on the application.

In fact, the latter are arranged around the burners, and their shape must keep a correct distance between the bottom of the pots laid thereon and the corresponding flame divider, so as to promote the generation of flames having the proper supply of oxidant air and ensuring good thermal exchange between them and the pot bottom, which mainly occurs by convection and irradiation.

The grates are usually made of metallic material, typically steel, and take up a large part of the cooking top of the household appliance, thus ensuring good pot stability.

For this reason, some grates consist of metal wires (typically made of stainless steel) welded together, or are made of cast iron or other cast metals (e.g. bronze, brass, etc.), and usually have a frame-like configuration with pot support arms or spokes extending inwards.

The geometry of the grate frame is usually polygonal (e.g. square, rectangular, trapezoidal) or circular, but it can be said that, de facto, there are no limitations as concerns the configuration of the grates, which are components that must be consistent with the design of the household cooking appliances for which they are intended.

One important aspect related to the grates from a structural and functional viewpoint is their stability on the respective top of the household appliance, on which also the stability of the pots depends.

It can be easily understood, in fact, that a grate not resting stably on the underlying surface may shake and impair the stability of a pot laid thereon.

In order to overcome this problem, grates are often provided with small feet or support appendices engaging into holes or seats provided on the top of the household appliance, so that they can be properly secured and prevented from making undesired movements or getting unbalanced, e.g. when pots are laid on or removed from the burners.

Said feet or protrusions may however scratch or damage the surface of the cooking top, especially when the latter are enameled or made of delicate materials or have delicate surface finishes, like quartz and glass tops, as well as those made of stainless steel.

For this reason, it is known to apply, under the grates, rubber pads or gaskets acting as cushions and preventing any direct contact between the grates and the support surface of the household appliance.

One example of a grate for household cooking appliances which is equipped with such pads, also commonly called "rubber pieces" by those skilled in the art, is shown in the published European patent application EP 964 207, which relates to a grate comprising curved pot support arms arranged in a cross-like pattern relative to the burner.

The curved arms are thin, and a rubber pad is applied to the underside thereof, which performs the above-described functions.

From a functional viewpoint, rubber pads are fully effective because they can prevent damage to the surface of the tops of cookers and other household cooking appliances.

However, they are additional elements of the grate that, though cost-effective adversely affects the final economical results in large-scale industrial productions such as those for gas cookers and other household cooking appliances.

It is therefore the object of the present invention to provide a pot support grate having such structural and functional features that allow overcoming the above-mentioned limitations of the prior art.

SUMMARY

The idea that achieves this object is to exploit the pads applied to the grates also for other advantageous functions, in addition to the original function of preventing household cooking appliances from suffering scratches and other similar damage.

According to one application, the pads have the property of changing their color with temperature: because of this, an indication can be provided regarding the temperature of the grate where the pads are applied, thus, for example, preventing a user from getting scalded when grasping a hot grate.

According to another possible application, the pads can be used for checking the operation of the household appliance on which the grate is laid.

According to an aspect of the disclosure, a support grate for a household cooking appliance includes a plurality of spokes with at least one portion on which a cooking article can be supported and at least one pad of elastic material for supporting the grate on a surface of the household appliance. The pad is of a polymeric material having a thermochromic pigment dispersed therein and causing the pad will to change in a color thereof at a first preset temperature.

According to another aspect of the disclosure, a cooking appliance including a cooking top, at least one grate having a plurality of spokes with at least one portion on which a cooking article can be supported, and at least one pad of elastic material for supporting the grate on the cooling top. The pad is of a polymeric material having a thermochromic pigment dispersed therein and causing the pad to change in a color thereof at a first preset temperature. The cooking appliance further includes a sensor detecting a change in the color of said at least one support pad.

DESCRIPTION OF THE DRAWINGS

The features of the invention will be specifically set out in the claims appended to this description; they will become more apparent in the light of the following description of one possible embodiment thereof with reference to the annexed drawings, wherein:

DETAILED DESCRIPTION

Figure 1:
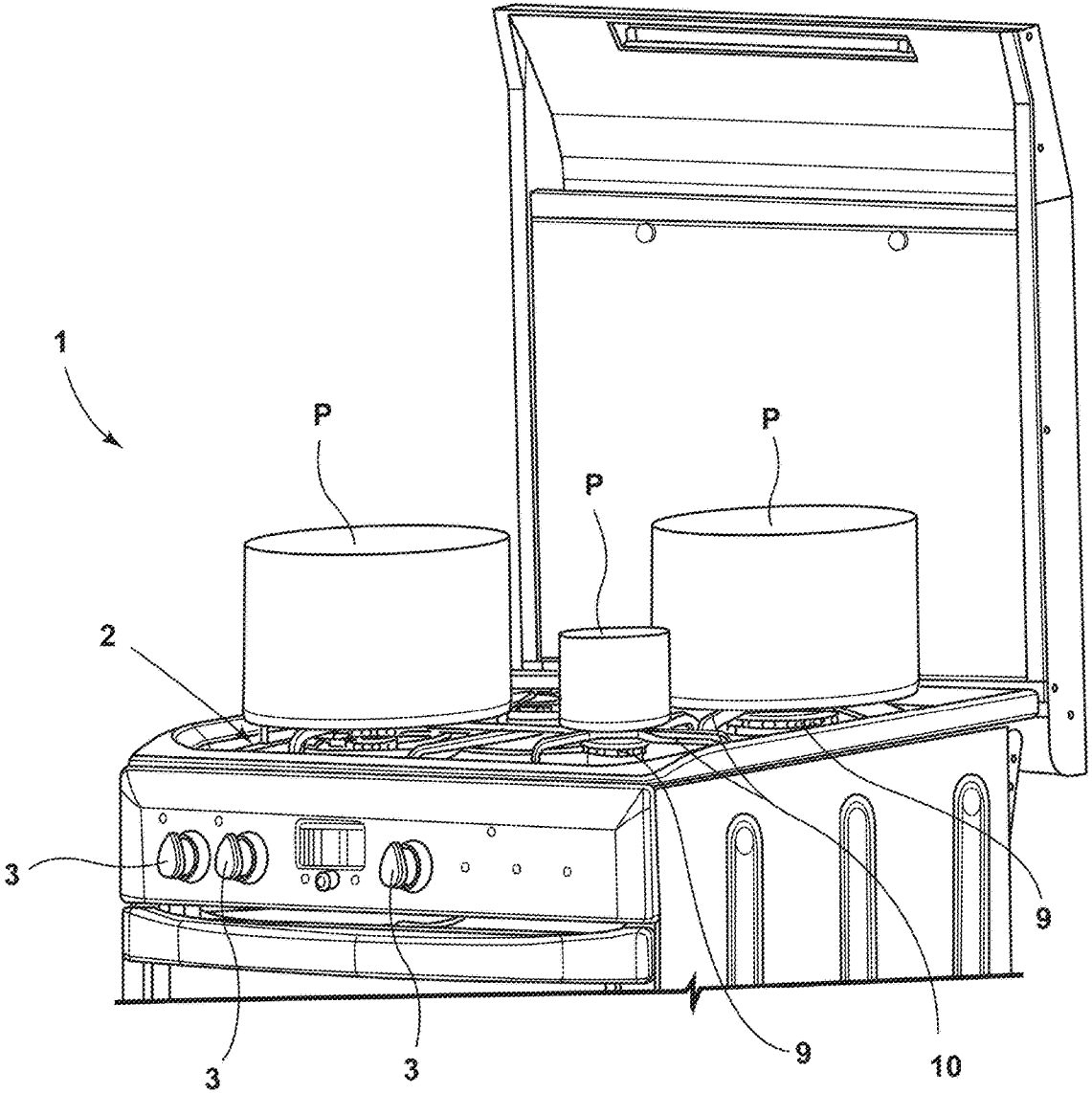
FIG. 1 shows a gas cooker with grates according to the invention.

With reference to the above-listed drawings, in particular to FIG. 1, a gas cooker according to the invention is designated as a whole by reference numeral 1.

In this regard, it is worth pointing out that reference will essentially be made in this description to those elements which are necessary or useful for understanding the invention and its features, neglecting for brevity the other parts; for further details, reference should be made to the technical teachings known in the art of household cooking appliances, particularly those manufactured by the present Applicant.

Therefore, as far as the gas cooker 1 is concerned, it comprises the typical known equipment useful for its proper operation, in addition to the parts involved in the present invention, which will be described below.

Likewise, it is also worth mentioning that the elements of the invention, the configuration thereof as shown in the drawings, and the respective explanations contained herein can be combined as deemed appropriate in one or more embodiments of the invention, the latter not being limited to the exemplary embodiments that will be taken into account herein.

The gas cooker 1 comprises a cooking top 2 whereon burners, controlled by knobs 3, are arranged as commonly known.

Figure 2:
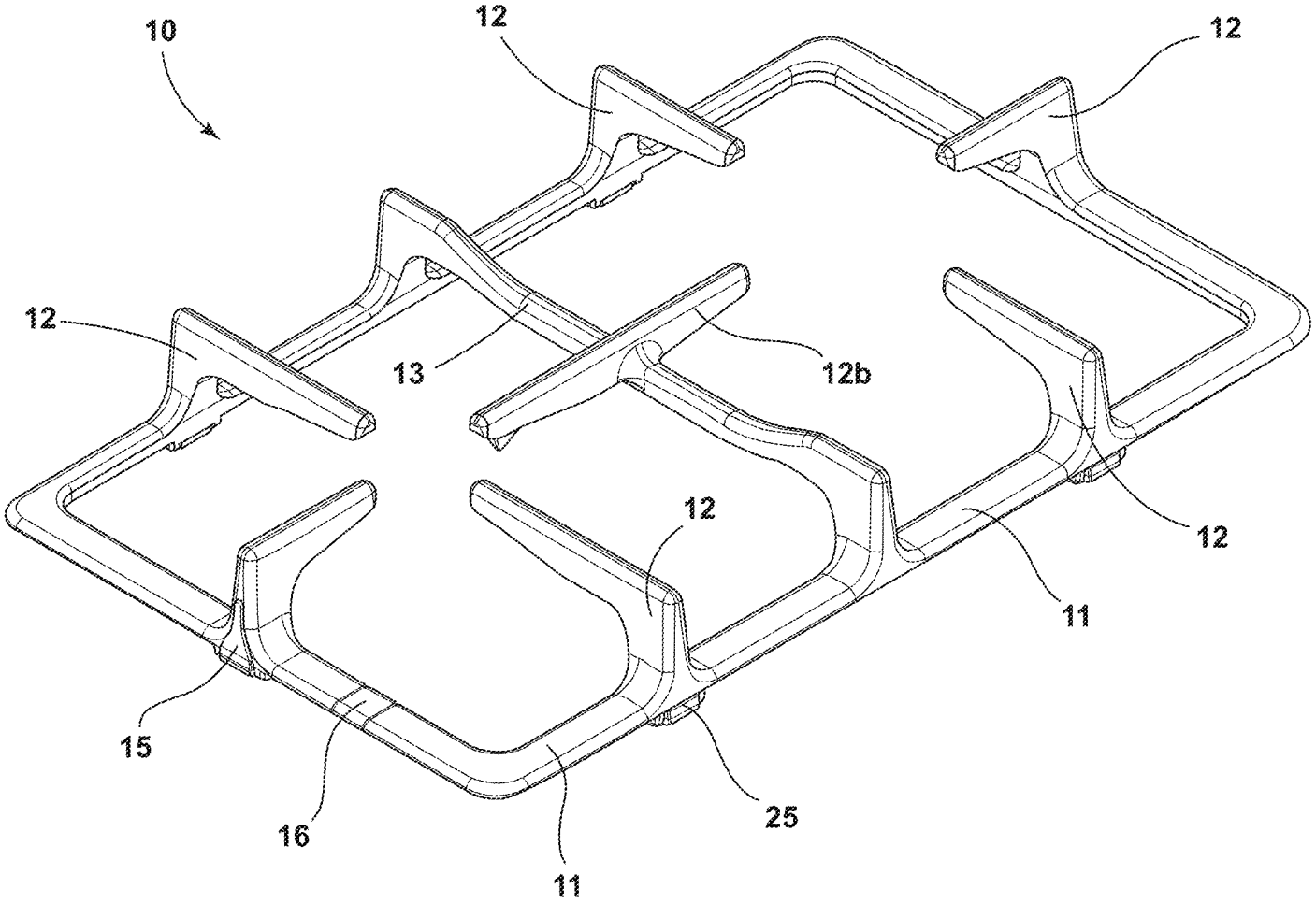
FIG. 2 is a perspective view of a grate according to the invention.
Figure 3:
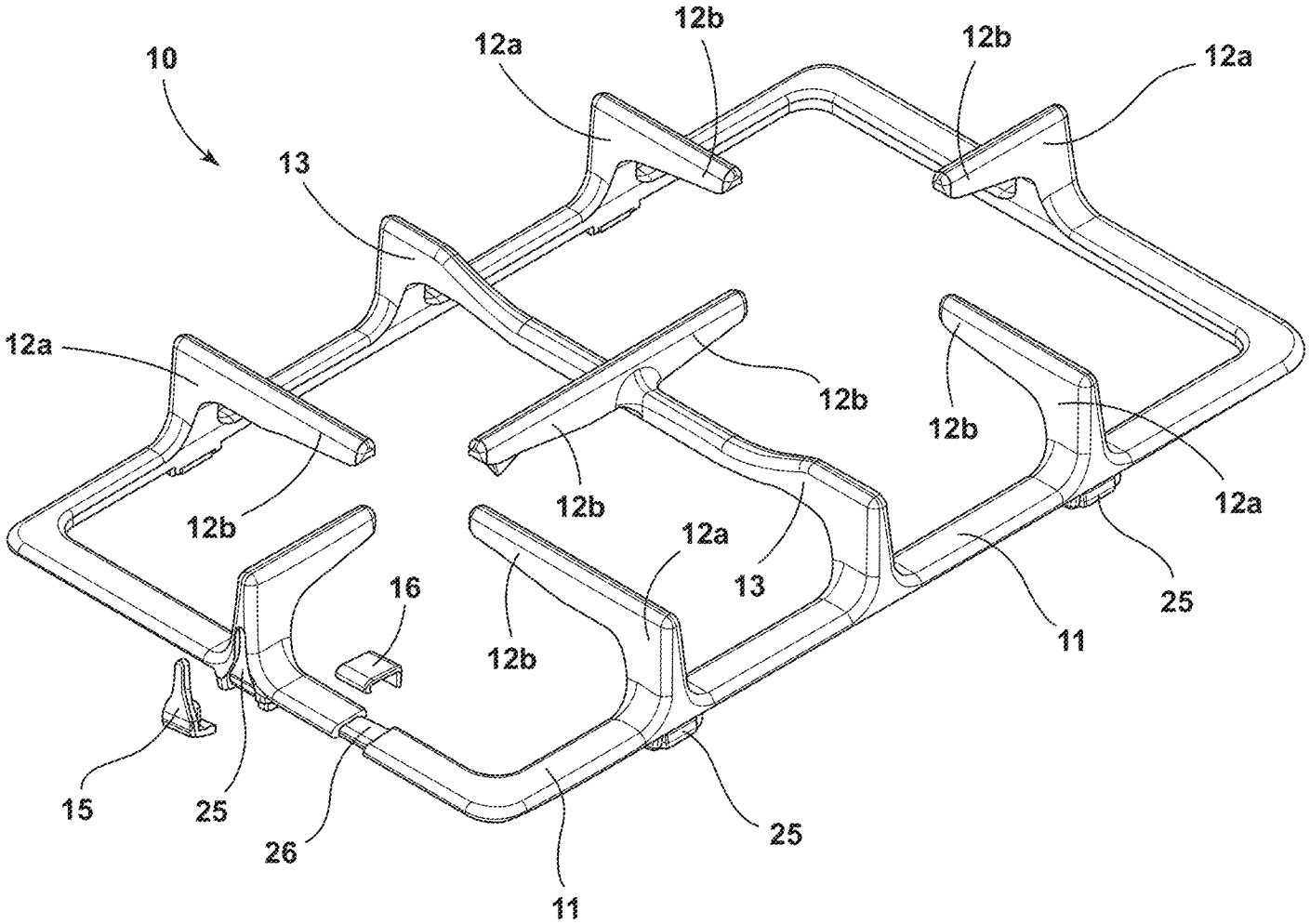
FIG. 3 shows the above grate with the thermochromic elements detached.

Grates 10 according to the invention are laid on the cooking top 2, one of which is shown in detail in FIGS. 2 and 3.

The grate 10 has a rectangular peripheral frame 11, from which arms or spokes 12 extend for supporting pots P (the latter are visible in FIG. 1).

The grate 10 is made of metallic material, such as steel, whether stainless steel or enameled steel or steel treated in any other appropriate manner as known in the art.

In this example, the spokes 12 are configured like a square, with a portion 12*a* attached to the frame 11 that extends vertically and a portion 12*b* for supporting the pot, which extends horizontally.

Advantageously, in this example the grate 10 comprises also a crosspiece 13 extending transversally to the frame 11 and supporting a horizontal portion 12*b* of the spokes 12.

In accordance with the invention, support pads 15, 16 made of soft polymeric material are applied under the frame 11; preferably, the pads are made from a silicone compound in which thermochromic pigments are dispersed.

The shape and dimensions of the pads 15, 16 may vary according to the case, depending on those of the grate 10 and spokes 12, the position thereof, as well as other factors.

What is important, however, is the fact that the pads 15, 16 have at least one portion protruding under the grate 10 or under the frame 11, if present, so as to prevent direct contact between the grate 10 and the top 2 of the household cooking appliance 1, thus avoiding scratches or other damage, as already explained.

A further condition that needs to be met by the grate 10 is that the support pads 15, 16 must remain visible once the grate has been arranged on the household appliance 1; this condition will depend on the shape of the grate and that of the top 2, which may be embedded into the structure of the household appliance 1, as shown in FIG. 1, or raised relative to the worktop, as is the case of cooking tops installed in modern kitchen units.

In order to fulfill this visibility condition, the pads 15 and 16 of the example shown herein are configured, respectively, as a square, applied to the vertical portions 12*a* of the spokes 12, and as a band, applied around the frame 11.

To this end, the latter and the spokes 12 have seats 25, 26 into which the pads 15 and 16 are engaged, so that they can be firmly mounted and accommodated on the grate.

As previously mentioned, the support pads 15, 16 are made of a polymeric material that needs to be elastic in order to provide a soft support for the grate on the top 2; however, the material must also be able to withstand the operating conditions of a cooking top, in particular temperatures that may reach high values, as well as aggressions from external agents such as liquids spilled on the grates and detergents used for washing.

The most suitable material capable of fulfilling such conditions is silicone-based rubber, which capably resists, when cooking, the temperatures reached by the areas where the pads are applied (in the range of 100-200° C.), and which have a polymeric matrix in which thermochromic pigments can be dispersed in an even or anyway predetermined manner, as will be explained below.

Pads can thus be made which, in addition to being suitable for supporting the grates because of their softness and elasticity, thus preventing the top surfaces from undergoing scratches or other damage, can also perform other advantageous functions.

Figure 6:
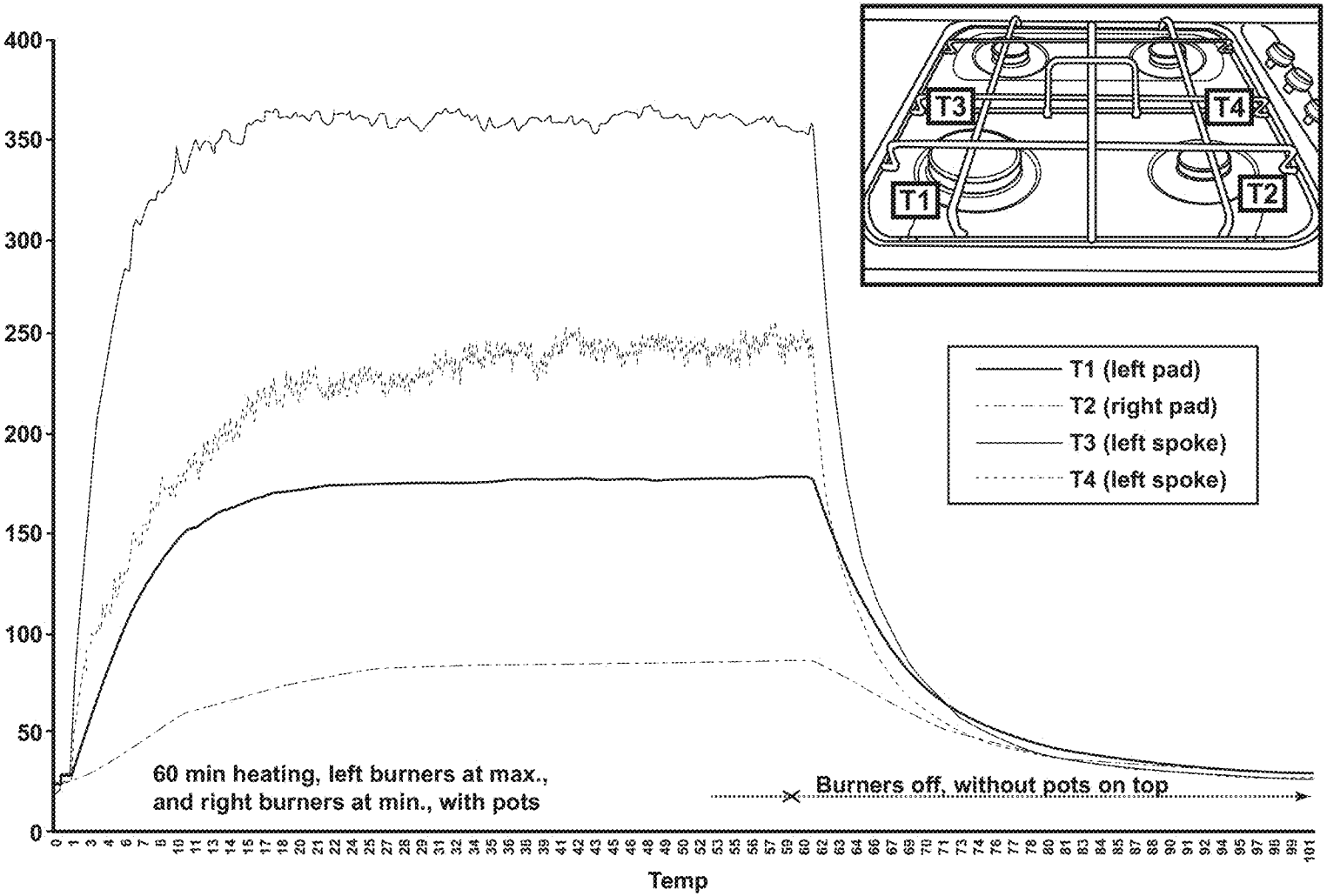
FIG. 6 is a graph that shows the temperature trend in the areas where the thermochromic pads according to the invention are applied, compared to other areas of the grate.

The graph of FIG. 6 shows the temperature trend over time in the areas of the grate 10 where the pads 15, 16, 20 are applied (designated as T1 and T2 in the image visible in the upper part of the graph), and in the portions 12*b* of the spokes 12 of the grate (designated as T3, T4), i.e. the portions that are closest to the flames of the burners.

As can be seen, the temperatures in the areas of the grate 10 where the pads 15, 16, 20 are located, i.e. on the frame 11, are lower than 200° C.: this allows the pads to operate in thermal conditions that are compatible with the properties of silicone-based rubber.

Thus, in a very simple embodiment, the pads 15, 16 will have, at ambient temperature, any one color given by the thermochromic pigments (e.g. black, green, magenta, cyan, brown, etc.), which will change when the pads reach a preset temperature corresponding to the color change, i.e. transition, temperature of the thermochromic pigments.

As is known, in fact, the latter have the property of changing color when they reach certain temperatures that may vary according to the pigment type.

In particular, thermochromic pigments tend to become transparent, so that, after transition, the pads 15, 16 will change color because they will show in transparency the color of the silicone-based matrix in which they have been dispersed.

Therefore, for this application red silicone will preferably be chosen, while the thermochromic pigments will be of another color, e.g. blue or black; the quantity and distribution of the pigments in the polymeric mass will be such that their color will prevail at ambient temperature, so that the pads will appear blue or black.

When the burners are in use, the grate 10 becomes hot and the pads 15, 16 are heated as well so that, when the color change temperature of the thermochromic pigments is reached, the latter will become transparent, thus showing the red color of the silicone in which they have been dispersed.

In this way, the pads 15, 16 will offer the user immediate visual perception of the fact that the grate 10 has become hot and must not be touched with bare hands.

The pads 15, 16 will nonetheless still perform their function as elastic supports for the grate 10, since silicone can withstand the operating temperatures of household cooking appliances.

In this respect, it must be pointed out that the arrangement of the pads 15, 16 under the grate 10, in particular under the frame 11, allows them to remain in areas sufficiently far from the flames of the burners, where temperatures in the range of 70-90° C. will be reached at most.

The thermochromic pigments can thus operate within optimal temperature ranges, ensuring high reliability of the invention.

Note that the temperatures of the spokes 12 and of their horizontal portions 12*b* will be higher than those of the frame 11; under this aspect, therefore, the arrangement of the pads on the frame and at least partly under it turns out to be advantageous.

In accordance with a preferred embodiment, the polymeric material of the pads 15, 16 comprises pigments of various colors, e.g. blue-magenta or yellow-blue, as well as other combinations, wherein each color corresponds to a respective color change temperature.

This will provide a more accurate indication about the temperature reached by the grate, which, in addition to preventing a user from getting scalded, may also be useful for controlling the household appliance.

In fact, when they include different pigments changing color at respective temperatures, the pads 15, 16 will take different colors as their temperature changes.

In addition to allowing the user to know if the grate is more or less hot, this can be used to advantage as an indication detectable by a sensor.

Figure 5:
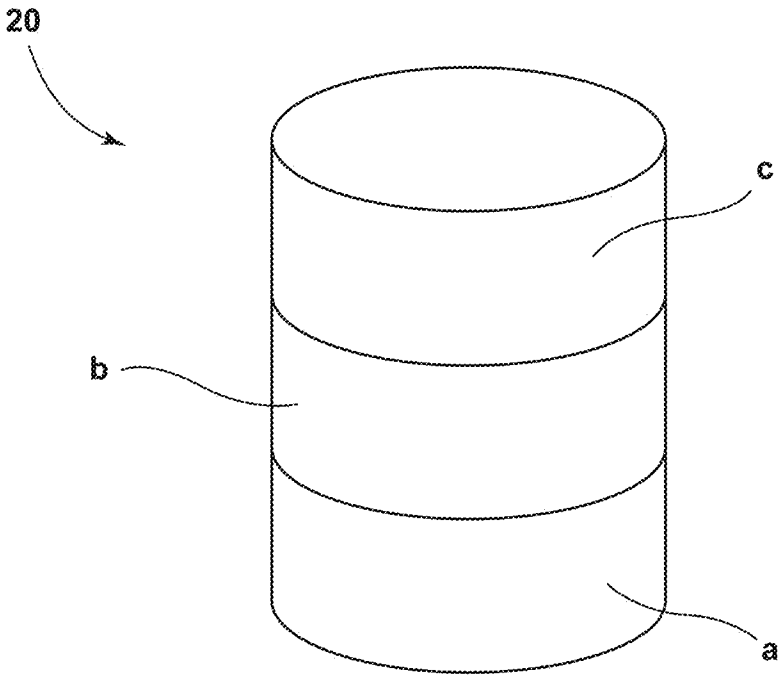
FIG. 5 shows a variant of a pad applied to a grate according to the invention.

In this case, the differently colored pigments may be mixed evenly in the polymeric silicone matrix, or they may be distributed in a predefined manner, e.g. in superimposed layers, as visible in FIG. 5, which schematically shows a pad variant 20 according to the invention.

The body of the pad 20 has a cylindrical shape (but it may be shaped like the previously discussed ones or otherwise), with three sectors a, b, c in which there are respective thermochromic pigments having different transition temperatures, so as to be able to provide a progressive indication of the temperature of the grate whereto the pad is applied.

By applying this pad to a household cooking appliance 1 as schematically shown in FIG. 1, the chromatic changes of the pad 20 can be detected by means of an optical sensor 4 arranged on the top 2 near the pad applied to the grate 10.

Optical sensors suitable for this purpose are commercially available (e.g. those marketed by Italian company ifm electronic) and are used for many industrial applications; they are therefore reliable and cost-effective.

In this regard, it must be pointed out that the sensor 4 may be arranged either in a seat formed in the cooking top 2 or underneath the latter, if the top 2 is transparent, so that it will allow the sensor to make chromatic detections through it.

The sensor 4 is operationally connected to an electronic board 5 for controlling the household appliance 1, which also comprises a display 6 and possibly a warning lamp 7.

As an alternative to this configuration, or as a combination therewith, the electronic board 5 is equipped with wireless communication means for remotely transmitting the information received from the sensor 4 to, for example, a mobile terminal (cellular phone, tablet or the like) of the user of the household appliance.

The household appliance also comprises an electrovalve 8 acting upon the gas delivery to the burner 9 on the cooking top 2, operationally associated with the knobs 3 as known in the art.

Should the sensor 4 detect an anomaly in the color of the pads 15, 16, 20, it will transmit a signal to the board 5, which will then control the electrovalve 8 to stop the supply of gas to the burner 9.

From the above description it can be understood how the grate of the invention achieves the expected object.

In fact, it is equipped with pads 15, 16, 20 for supporting it on the cooking top 2 of the household appliance 1, which, in addition to preventing scratches and ensuring elastic support of the grate, thereby improving its stability, makes it possible to achieve advantageous effects such as higher safety for both the user and the household appliance.

The former can thus realize, in fact, when the grate is hot and requires attention, while the chromatic information provided by the pads can be advantageously used for controlling the household appliance.

Of course, the invention as described so far may be subject to variations, both because the possible shapes of the support grates are numerous and depend on the cookers they are intended for which, what is more, must not necessarily be gas cookers and because the thermochromic pads may have different shapes as well.

For example, the utilization of the chromatic change of the thermochromic pads 15, 16, and 20 for controlling the household appliance by using sensors 4 is also applicable to the case wherein the cooking top 2 is made of stainless steel or another non-transparent material (ceramic, enameled, etc.).

Figure 4:
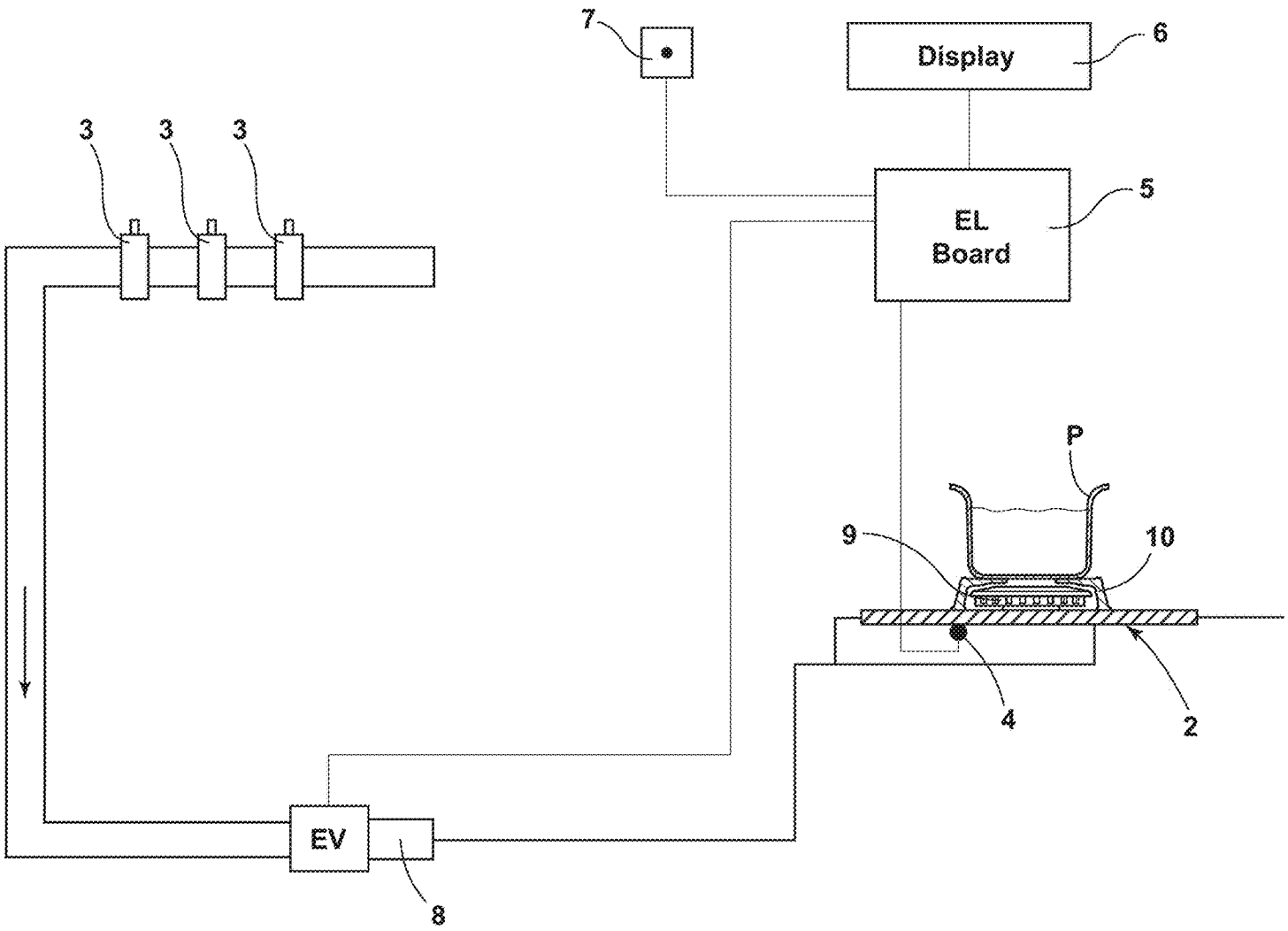
FIG. 4 is a diagram that illustrates the operation of a household cooking appliance equipped with a grate according to the invention.

In such a case, the sensor 4 may be arranged on the cooking top 2, so as to have direct visual access to the thermochromic pads, or the cooking top 2 may be provided with transparent areas in the form of glass set into stainless steel or the like, so that the sensor 4 can be positioned under the top as in FIG. 4 and still have visual access to the thermochromic pads 15, 16, and 20.

Finally, it is worth mentioning that the presence of thermochromic pigments with respective different colors and color change temperatures applies to both of the pads 15, 16, since it is possible to provide stratiform divisions both in the square-like shape of the pad 15 and in the band-like shape of the pad 16.

These variants will still fall within the scope of the following claims.

The invention claimed is:

1. A support grate for a household cooking appliance, comprising:

a peripheral frame;

a plurality of spokes extending from the frame with at least one portion on which a cooking article can be supported; and at least one pad of elastic material positioned adjacent to a surface of the household appliance in a support position for supporting the grate on the surface of the household appliance, wherein the pad is of a polymeric material having a thermochromic pigment dispersed therein and causing the pad to change in a color thereof at a first preset temperature.

2. The grate according to claim 1, wherein said at least one pad comprises a portion that extends under the grate in contact with the surface of the household appliance.

3. The grate according to claim 1, wherein said at least one pad at least partly contacts the frame.

4. The grate according to claim 1, wherein the thermochromic pigment is one of a plurality of thermochromic pigments dispersed in the polymeric material of the pad, each of the plurality of thermochromic materials having respective different colors and causing respective changes in color of the pad at respective ones of a plurality of preset temperature values, including the first preset temperature value.

5. The grate according to claim 4, wherein the plurality of thermochromic pigments are dispersed within respective sectors of the pad and arranged sequentially according to the respective ones of the preset temperature values to provide a progressive indication of a temperature of the grate.

6. The grate according to claim 1, wherein the polymeric material comprises a silicone-based rubber.

7. A cooking appliance, comprising:

a cooking top;

at least one grate including a plurality of spokes with at least one portion on which a cooking article can be supported;

at least one pad of elastic material for supporting the grate on the cooking top, wherein the pad is of a polymeric material having a thermochromic pigment dispersed therein and causing the pad to change in a color thereof at a first preset temperature; and a sensor detecting a change in the color of said at least one support pad, wherein the cooking top is substantially transparent to wavelengths corresponding to a color of the at least one pad, and the sensor is positioned under the top.

8. The household appliance according to claim 7, further comprising a control board programmed to communicate with an electrovalve to stop a supply of gas to a burner associated with the at least one grate when the pad exhibits a predetermined color or a predetermined combination of colors.

9. The household appliance according to claim 8, further comprising a display, wherein the control board is further programmed to cause a warning indication to be presented on the display when communicating with the electrovalve to stop the supply of gas to the burner.

10. The household appliance according to claim 8, further comprising a warning lamp, wherein the control board is further programmed to cause the warning lamp to illuminate when communicating with the electrovalve to stop the supply of gas to the burner.

* * * * *